United States Patent [19]

Hubert et al.

[11] Patent Number: 4,813,245

[45] Date of Patent: Mar. 21, 1989

[54] HIGH EFFICIENCY LINEAR FREEZER

[75] Inventors: Jean-Luc Hubert, Willowbrook; Todd Harvey, Hinsdale; Miles Bajcar, Palos Hills, all of Ill.

[73] Assignee: Liquid Air Corporation, Walnut Creek, Calif.

[21] Appl. No.: 143,443

[22] Filed: Jan. 13, 1988

[51] Int. Cl.[4] ..... F25D 25/04

[52] U.S. Cl. ..... 62/380; 62/266

[58] Field of Search ..... 62/380, 266; 34/213, 34/224

[56] References Cited

U.S. PATENT DOCUMENTS

| | | | |
|---|---|---|---|
| 3,533,245 | 10/1970 | Komberec et al. | 62/266 |
| 3,728,869 | 4/1973 | Schmidt | 62/266 |
| 3,841,109 | 10/1974 | Cann | 62/266 |
| 3,855,815 | 12/1974 | Wagner | 62/266 |
| 3,879,954 | 4/1975 | Cann | 62/63 |
| 4,229,947 | 10/1980 | Klee | 62/380 |
| 4,528,819 | 7/1985 | Klee | 62/266 |
| 4,589,264 | 5/1986 | Astrom | 62/380 |

*Primary Examiner*—Ronald C. Capossela

*Attorney, Agent, or Firm*—Lee C. Robinson, Jr.

[57] ABSTRACT

A linear freezer for cooling and/or chilling and/or crust freezing and/or freezing various products, said freezer using carbon dioxide or nitrogen. The freezer comprises means to balance the exhausted cold gas between the entry and exit openings and sucking means, to extract the exhausted cold gas at said both entry and exit openings, with no substantial variation of flowrate of the exhausted cold gas than that generated from the enclosure without said sucking means.

10 Claims, 3 Drawing Sheets

HIGH EFFICIENCY LINEAR FREEZER

BACKGROUND OF THE INVENTION

The present invention relates to a linear freezer for cooling and/or chilling and/or crust freezing and/or freezing various products using gaseous and solid carbon dioxide, or gaseous and liquid nitrogen.

Such type of linear freezers are known from U.S. Pat. No. 3,841,109 and 3,879,954 incorporated herein as references.

They are composed of one or several adjacent modular sections forming an insulated enclosure through which various products are transported by one stainless steel endless conveyor belt (single tier freezer) or by three parallel and superposed stainless steel endless conveyor belts (triple tier freezer) of selected width from one entry opening (generally of manually adjustable cross-section) to one exit opening (generally of manually adjustable cross-section). Carbon dioxide gas atmosphere of said freezer is maintained at low temperatures by automatically regulated injection/expansion of high pressure liquid carbon dioxide into ambient-pressure carbon dioxide gas solid mixture through regularly spaced and orientable injection orifices in injection headers located in the vinicity of the roof of each modular section. (When nitrogen is used, nitrogen gas atmosphere is maintened at low temperature by automatically regulated injection of pressurized liquid nitrogen). Removal of heat from products occurs through forced gas convection created by two fans of given characteristics in each modular section and by kinetic energy of previously mentioned carbon dioxide expansion jets from injection orifices and through sublimation of carbon dioxide snow particles deposited on the surface of products or through evaporation of liquid nitrogen droplets on the surface of products. Said fans, of diameter equal to or less than the previously mentioned width of the conveyor belt, run at a high, manually selectable velocity and have a high delivery flowrate, thereby cresting a high heat removal capability and hence a high performance for said freezer.

These known linear freezers while satisfactory, thanks to their high performances, exhibit low efficiency because carbon dioxide or nitrogen is only partially used to remove heat from the products, the remaining portion being lost because of heat conduction through the freezer insulation, of degradation into heat of the kinetic energy of the flow created by the fans, of heat input from the product conveyor belt after warm-up in product unloading and especially product loading zones, and of heat input from large infiltrations of warm moist room air into the freezer atmosphere.

These known linear freezers which are sold by the CARDOX Corporation a division of LIQUID AIR Corporation under the commercial name "ULTRA-FREEZE" do not have however the drawbacks exhibited by other freezers : because of the high velocity and high delivery of the fans used in said "ULTRA-FREEZE" freezer, the fan blades do not cover with ice and frost and thereby do not loose their efficiency and delivered flow characteristics (flowrate, flow speed, flow distribution). Furthermore, they utilize the kinetic energy of carbon dioxide espansion jets and the sublimation latent heat of carbon dioxide snow particles or evaporation of nitrogen droplets in addition to the velocity of the flow created by the fans for heat removal from the products, thereby further enhancing the performances (i.e. capacity production) compared to those of said other freezers.

SUMMARY OF THE INVENTION

The present invention aims at improving the flow characteristics of the exhaust carbon dioxide or nitrogen gas flows at entry and exit ends, improving the balance between said exhaust flows at said ends, improving the way the said exhaust flows are extracted at said ends, and, as a consequence, reducing the amount of heat picked up by the conveyor belt between the time it leaves the enclosure formed by the freezer, for loading the warm products or for unloading the cold products, and the time it reenters said enclosure.

Exhaust carbon dioxide or nitrogen gas is extracted at both ends of the freezer by suction. The flow characteristics of said exhaust gas are optimized through specific means, which comprise two draft boxes of suitable dimensions placed around and below respectively the entry end and the exit end of the freezer, without physical connection to the inner volume of the enclosure defined as the freezer, thereby capturing the exhaust carbon dioxide or nitrogen gas naturally exiting the freezer without acting on said exhaust gas flow. The use of said draft boxes eliminates the zones of negative pressure usually encountered at the ends of linear freezers of the prior art, thereby reducing the fluctuating parasite entries of warm room air into the cold atmosphere of the freezer, and thereby increasing the efficiency level of-and the reliability and reproducibility of the efficiency level of the freezer.

According to a preferred embodiment of the invention, said draft boxes are such that they create a cold carbon dioxide or nitrogen gas blanket around the sections of conveyor belt usually exposed to ambient room atmosphere, preferably at both ends of the freezer, but at least at the entry end of the freezer where products are loaded on the conveyor belt, thereby cancelling the warming-up of said belt sections at said locations, and further increasing the efficiency of the freezer.

According to another embodiment of the invention, said means further comprise, on the one hand, fixed stainless steal or other rigid material baffles placed between the fans of each modular section, effectively closing the region defined by the ceiling of said modular section and level of blades of said fans, and on the other hand manually orientable stainless steel or other rigid material baffles. The use of said fixed and said orientable baffles allows precise control of balance between exhaust flow at entry end and exhaust flow at exit and, thereby cancelling the possibility of a flow of warm room air through the freezer usually encountered on freezers of the prior art with exhaust imbalance.

According to a further embodiment of the invention, said means comprise a stainless steel or other rigid material circular shroud at least around the entry fan (or the fan which is nearest to the entrance) and preferably around both the entry fan and the exit fan (or the fan nearest to the entrance and exit). Use of said shrouds reduces the velocity and turbulence of said exhaust flow over the width of the belt, thereby reducing the residual amount of possible room air infiltration into the freezer induced by local flow circulation patterns at entry end and at exit end. Combination of said exhaust draft boxes, of said adjustable and fixed baffles and of said end fans shrouds yields a very high efficiency for the freezer with said apparatus.

BRIEF DESCRIPTION OF THE DRAWINGS

Other and further features of the invention will be clearly understood by reference to the following description of various embodiments of the invention chosen for purpose of illustration only, along with the claims and the accompanying drawings, wherein:

FIG. 1 shows schematically a linear freezer according to previously known technology to which the present invention can be applied. That freezer is delimited by an insulated enclosure 1 with an entry opening 2 and an exit opening 3 through which the products placed on the conveyor belt 4 enter and leave the freezer. The products 5 are refrigerated in the freezer by the flow of carbon dioxide or nitogen gas created by the fans 6. Temperature inside the freezer is maintained by injecting carbon dioxide or nitrogen in the freezer atmosphere through suitable means 7 such as orifices of predetermined diameter at one or several locations in the freezer. Said injection is regulated by a suitable controller 8 which closes or opens a solenoid valve 9 depending on the temperature measured by one or several temperature sensors 10. The exhaust carbon dioxide or nitrogen gas is sucked from the linear freezer by a suction fan 11 and mixed with room air provided by a side channel 12 at both ends of the freezer. The exhaust apparatus can be located either at the top of the freezer such as 13 or at the bottom of the freezer such as 14.

Figure 1:
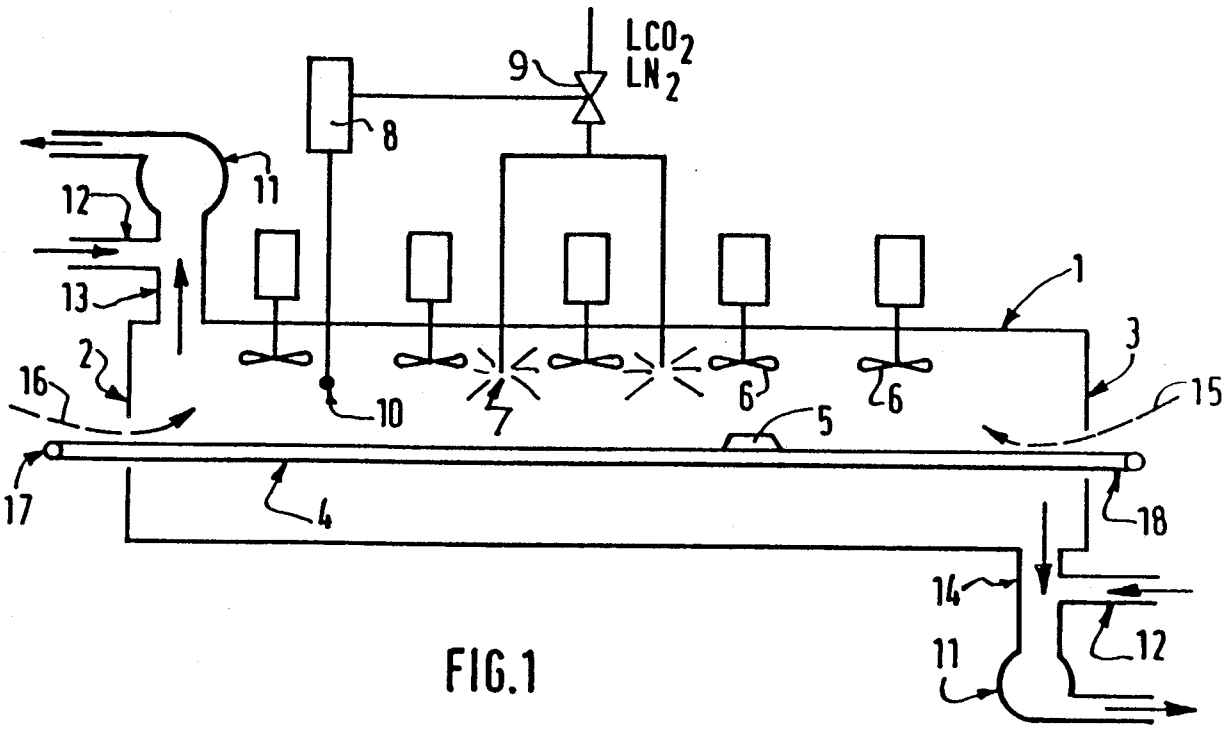
FIG. 1 is a cross-section view outlining previously known tunnel freezers.

Due to the negative pressure created by the exhaust apparatus at both ends of the linear freezer, due to the interaction between high velocity fans and due to the local circulation created by the end fans, warm room air enters the freezer as schematically shown by arrows 15 and 16, thereby creating an additional heat load of significant magnitude and consequently a waste of carbon dioxide or nitrogen. Finally, the conveyor belt 4 is cyclically cooled within enclosure 1 and warmed at loading zone 17 and warmed at unloading zone 18 thereby creating an additional heat load.

Figure 2:
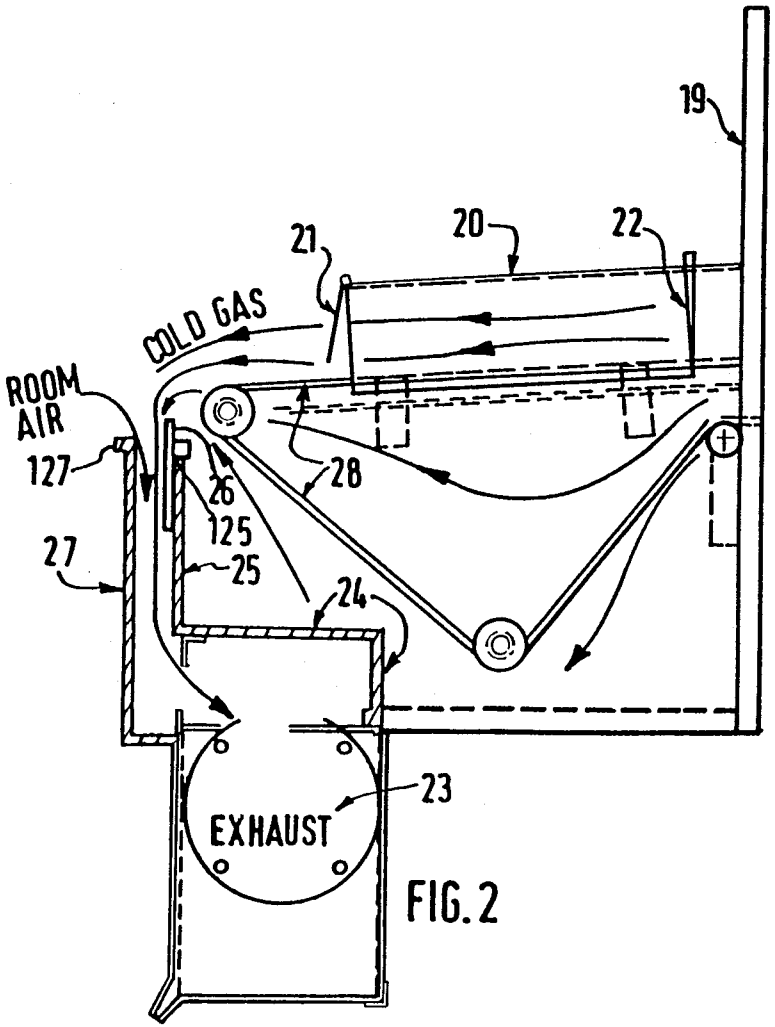
FIG. 2 is a cross-section view of the vestibule at entry end of the system according to the present invention.

FIG. 2 shows the exhaust apparatus at the loading zone according to the present invention and the resulting gas flow pattern. Next to the wall 19 of the first module, an easily removable enclosure 20 of stainless steel or other rigid material covers part of the loading zone. One flexible curtain 21 and optionally a second flexible curtain 22 are attached to the cover 20. The exhaust duct 23 connected to an exhaust blower (not represented on the drawing) is physically separated from the freezer by plate 24 and by plate 25. Consequently there is no suction of gas from the freezer enclosure but only suction of gas that has left the freezer enclosure and of room air. Plate 25 is dotted with a sliding plate 26 which can be raised or lowered in order to accomodate eventual product loading mechanisms. The suction of the exhaust is guided by the easily removable draft box 27. The top 127 of the draft box is generally below the level of the belt 28 but high enough to permit adequate cool gas suction. In practice, it will be about level with the top 125 of plate 25.

The cold gas exiting the freezer does therefore flow naturally over and below the conveyor belt 28 until it reaches plate 26 and is then picked up by the suction of the exhaust and flows through the channel formed by draft box 27 and plates 24, 25 and 26 to the exhaust duct 23 which evacuates the cold gas. In the freezers according to prior art the exhaust acted directly on the freezer atmosphere thereby creating negative pressure zones within the freezer which sucked warm room air into the freezer.

Not shown on FIG. 2 is a manually adjustable sliding vertical plate used to increase or reduce the area of the entry and opening depending on product height located immediately drownstream of 19.

Figure 3:
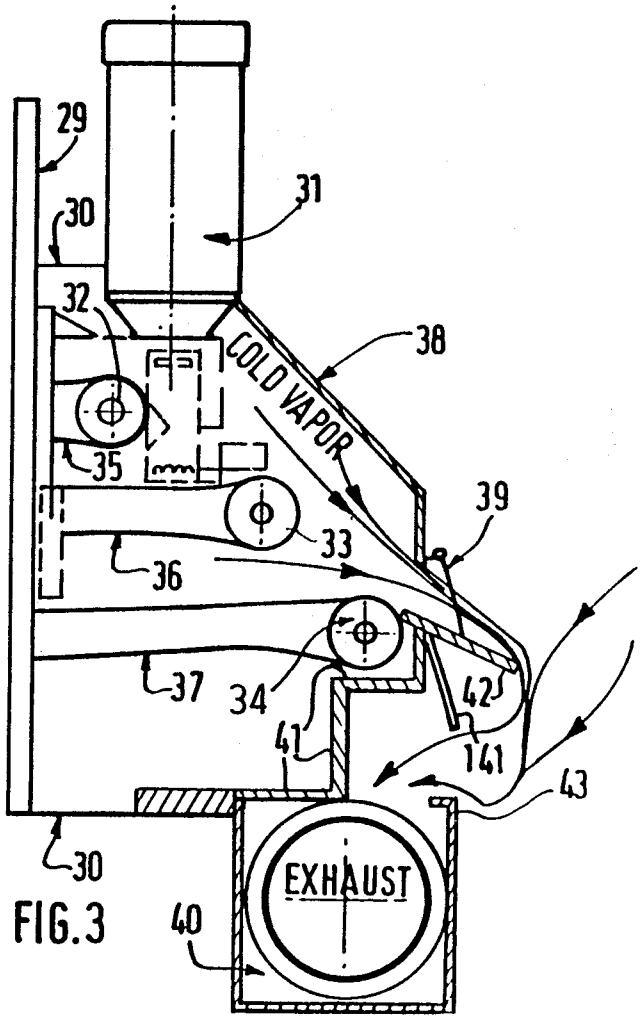
FIG. 3 is a cross-section view of the vestibule at exit end of the system according to the present invention.

FIG. 3 shows the exhaust apparatus at the unloading zone according to the present invention and the resulting gas flow pattern. Next to the wall 29 of the last modular section, an enclosure 30 of rigid material supports the conveyor belts driving motor 31 and the shafts 32, 33 and 34 of the upper 35, middle 36 and lower 37 conveyor belts. A hinged stainless steel or other rigid material hatch 38 allows for easy cleaning of that exit vestibule 30. One flexible curtain row 39 is attached to the hatch 38 at the product exit opening. The exhaust duct 40 is physically separated from the freezer by plate 41 and by the product discharge plate 42. Consequently there is no direct suction of gas from the freezer enclosure but only suction of gas that has left the freezer enclosure and of room air. The suction of the exhaust is guided by the easily removable draft box 43 and by plates 41 and 42. The cold gas exiting the freezer does therefore flow naturally over the product discharge plate 42 and is then picked up by the suction of the exhaust and flows through the channel formed by draft box 43 and plates 41 and 42 to the exhaust duct 40 (connected to an exhaust blower, not represented on the figure) which evacuates the cold gas. Plate 42 must be of adequate length to direct exiting products beyond draft box 43. Furthermore, there is provided a plate 141 to control the opening area defined by the top of draft box 43 and the lower end of plate 141, in order to provide proper cool gas suction.

Design for a single tier freezer is identical to that of the triple tier shown in FIG. 3. In the freezers according to the prior art, the exhaust acted directly on the freezer atmosphere thereby creating negative pressure zones within the freezer which sucked warm room air into the freezer.

Figure 4:
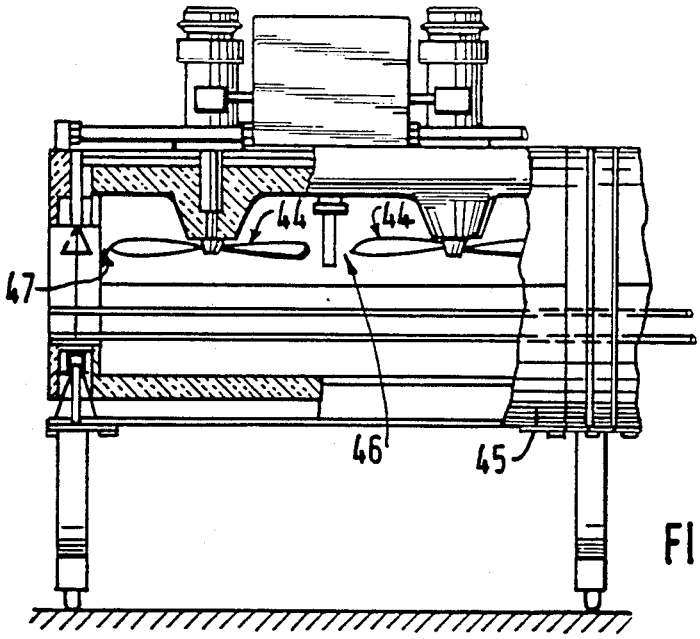
FIG. 4 is a cross-section view of a modular section of the linear freezer according to the invention with a fixed baffle and an adjustable baffle.

FIG. 4 shows the baffles 46, 47 ensuring an even distribution of the exhaust carbon dioxide or nitrogen flow between the entry end exhaust shown on FIG. 2 and the exit and exhaust shown on FIG. 3. Even distribution is obtained by action on the horizontal flow vectors created by the high velocity fans 44 through one fixed stainless steel or other rigid material baffle 46 placed in between the two fans 44 of each modular section 45 which effectively cancels the horizontal flow vectors created by the two fans 44 next to the freezer enclosure wall. Such arrangement in each modular section 45 allows for a very good control over the distribution of carbon dioxide or nitrogen exhaust flows by means of adjustable stainless steel or other rigid material baffles 47 located at selected interfaces between two adjacent modular sections 45. The angle of the adjustable baffle 47 is presently manually controlled by a handle mounted on the outside of the freezer but could be automatically regulated based on the indications of temperature sensors in the exit end and entry end exhaust draft boxes.

Figure 5:
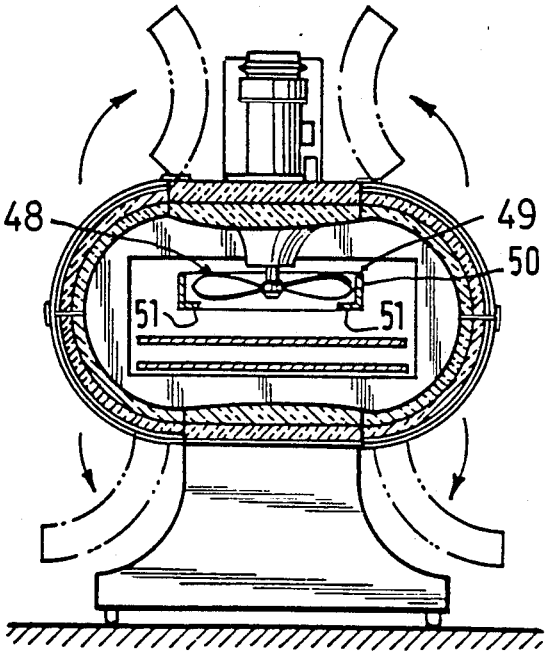
FIG. 5 is a cross-section view of the entry or exit end modular section of the freezer with a shroud around the end fan according to the present invention.

FIG. 5 shows the means of ensuring uniform distribution along the width of the entry and exit openings through action on the horizontal flow vectors created by the first, respectively last fan 48 of the linear freezer. Those horizontal flow vectors create a high velocity outflow of carbon dioxide or nitrogen gas on one side of the freezer product openings and an inflow of warm room air on the other side of those openings. That disymetric flow is cancelled through the use of a circular shroud 49 of stainless steel or other rigid material. Said shroud may be either a vertical cylinder 50 of height proportional to the fan blade geometry with a horizontal circular lip 51, or a conical cylinder.

We claim:

1. A linear freezer comprising an enclosure provided with an entry opening and an exit opening, means for transporting products to be cooled through said enclosure from said entry to said exit openings, spraying means to spray carbon dioxide or nitrogen which generates a cold atmosphere in the enclosure, means to circulate said cold atmosphere in the freezer enclosure, means to balance the exhausted carbon dioxide or nitrogen flows between the said entry opening and the said exit opening and sucking means to extract the exhausted carbon dioxide or nitrogen gas from the enclosure at both entry and exit openings, said means sucking the exhausted carbon dioxide or nitrogen flows through said entry and exit openings and being located in relation to said openings in such a way that they provide no substantial variation of flowrates of said exhausted carbon dioxide or nitrogen flows than that generated from the enclosure without said sucking means.

2. A linear freezer according to claim 1, wherein said means for transporting products comprise at least one conveyor belt or selected width.

3. A linear freezer according to claim 2, wherein said means to circulate the cold gas in the enclosure comprise at least one fan having a propeller diameter equal to or smaller than the usable width of said conveyor belt.

4. A linear freezer according to claim 1, wherein it further comprises means to provide a cold carbon dioxide or nitrogen gas blanket around the conveyor belt in the vicinity of the exit of said belt from the enclosure.

5. A linear freezer as claimed in claim 4, further comprising exhaust carbon dioxide or nitrogen gas flow optimization means placed around the fan next to the entry end, said means leaving the space above and below said fans open.

6. A linear freezer as claimed in claim 4, wherein the exhaust carbon dioxide or nitrogen gas flow optimization means and the exhaust carbon dioxide or nitrogen gas extraction means create a blanket of cold carbon dioxide or nitrogen gas and air mixture around the product conveyor belt when exiting the freezer for loading and unloading products.

7. A linear freezer as claimed in claim 1, wherein said sucking means are rigid material draft boxes placed around and slightly below the entry end where products are being loaded around and slightly below the exit end of the freezer where products are being unloaded.

8. A linear freezer according to claim 7, wherein said draft boxes have no physical connection to the gaseous atmosphere within the freezer and have suitable dimensions to accomodate the flowrate of exhaust carbon dioxide gas naturally exiting from the enclosure.

9. A linear freezer as claimed in claim 1, wherein the exhaust carbon dioxide or nitrogen gas flows balancing means comprise fixed rigid material baffles and orientable rigid material baffles.

10. A linear freezer as claimed in claim 1, further comprising exhaust carbon dioxide or nitrogen gas flow optimization means placed around the fan next to the entry end, said means leaving the space above and below said fans open.

* * * * *